United States Patent [19]

Kaufmann

[11] 4,332,456

[45] Jun. 1, 1982

[54] GRAPHIC ARTS PROCESSOR HAVING SWITCH SELECTABLE REPLENISHMENT CONTROL INFORMATION MATRICES

[75] Inventor: Kenneth M. Kaufmann, Minneapolis, Minn.

[73] Assignee: Pako Corporation, Minneapolis, Minn.

[21] Appl. No.: 167,834

[22] Filed: Jul. 14, 1980

[51] Int. Cl.[3] ..... G03D 3/00

[52] U.S. Cl. ..... 354/298; 354/299; 355/27

[58] Field of Search ..... 354/297–299, 354/319–322, 324–327; 355/27

[56] References Cited

U.S. PATENT DOCUMENTS

| | | | |
|---|---|---|---|
| 3,696,728 | 10/1972 | Hope | 354/298 |
| 3,699,869 | 10/1972 | Jensen | 354/298 X |
| 3,822,723 | 7/1974 | Crowell et al. | 354/297 X |
| 3,905,698 | 9/1975 | Schroter et al. | 354/298 X |

*Primary Examiner*—L. T. Hix
*Assistant Examiner*—W. J. Brady
*Attorney, Agent, or Firm*—Kinney, Lange, Braddock, Westman and Fairbairn

[57] ABSTRACT

A graphic arts processor capable of processing photosensitive film and paper includes digital storage for storing a replenishment control matrix formed from a plurality of individual information matrices for different photosensitive materials. Each information matrix includes replenishment control information, an indication of whether the photosensitive material is film or paper, and transport speed control information. Selector switches select one of the individual information matrices for controlling operation of the processor. A transport speed control controls the transport speed of the processor as a function of the speed control information in the selected information matrix. The replenishment control provides replenishment of the processor fluid as a function of the replenishment control information and either film density signals from a density scanner or predetermined paper density signals. The replenishment control uses the paper density signal when the information matrix includes an indication that the photosensitive material is paper, and disables the density scanner of the processor from providing density signals. Temperature control information for both solution heaters and dryer heaters is stored separately of the information matrix. Control of the solution and dryer heaters is based upon the stored temperature control information.

15 Claims, 3 Drawing Figures

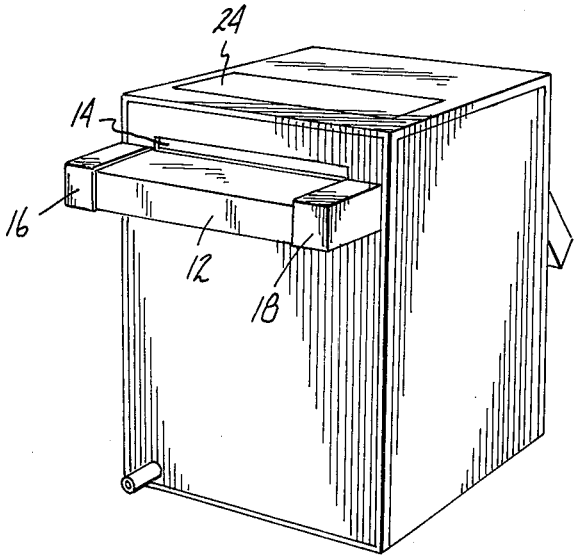
Fig. 1
Fig. 2
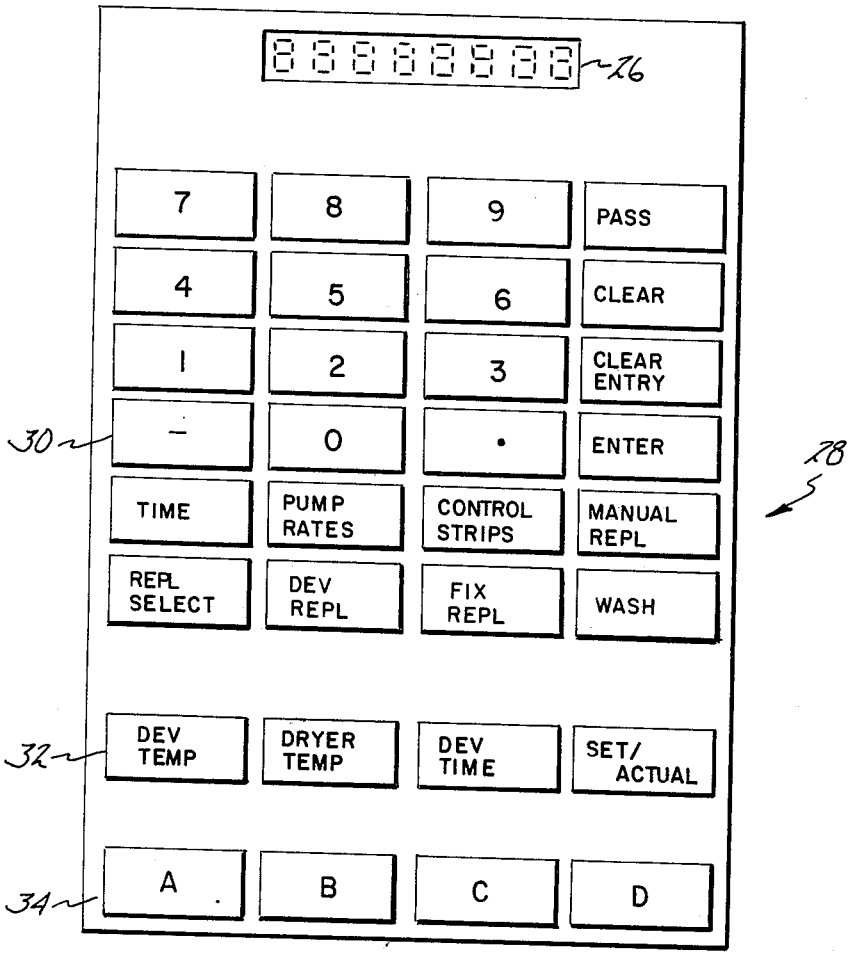

GRAPHIC ARTS PROCESSOR HAVING SWITCH SELECTABLE REPLENISHMENT CONTROL INFORMATION MATRICES

BACKGROUND OF THE INFORMATION

1. Field of the Invention

The present invention relates to control systems for processors of photosensitive material.

2. Description of the Prior Art

Automatic photosensitive film and paper processors transport sheets or webs of photographic film or paper through a sequence of processor tanks in which the photosensitive material is developed, fixed and washed, and then transports the material through a dryer. Particularly in the case of graphic arts processors, it is desirable to use the same processor for both film and paper. In many cases, however, this has not been possible with prior art processors. The rates of replenishment, transport speed of material through the processor, and temperatures of the solutions and the dryer can vary significantly from material to material.

In the prior art processors of photosensitive material, the changeover from running one type of photosensitive material to another has often been somewhat time-consuming. In general, a number of separate adjustments have been required by the operator each time a different type of material is to be processed. This, of course, reduces the overall operating efficiency of the processor.

SUMMARY OF THE INVENTION

In the processor of the present invention, a wide variety of different photosensitive materials may be processed while requiring a minimum of operator adjustments each time the material to be processed changes. The control system of the processor includes storage means for storing a plurality of information matrices for a plurality of different photosensitive materials. Each information matrix includes replenishment control information and an indication of whether the photosensitive material is film or paper. The information matrix also preferably includes speed control information for controlling the transport speed of the material through the processor.

Select means select one of the information matrices corresponding to the photosensitive material to be processed. Replenishment control means provide replenishment of processor fluid as a function of the replenisher control information from the selected information matrix and the indication of whether the photosensitive material is film or paper.

In preferred embodiments, the processor includes density sensing means for providing film density signals indicative of measured density of photosensitive film which has been processed in the processor. Since the processed paper is opaque, density signals from the density sensing means would provide inaccurate density information. In the present invention, paper density signals are separately provided to indicate the density of the images on the photosensitive paper. These paper density signals, for example, may be provided by the operator through operator controlled switches. The replenishment control means selects either the film density signals or the paper density signals depending upon the indication stored in the information matrix as to whether the material is film or paper.

The control system of the present invention also preferably includes speed control means for controlling transport speed of photosensitive material through the processor, and temperature control means for controlling temperature of processor solution and dryer temperature. The information matrices preferably include speed control information used by the speed control means in controlling transport speed of the photosensitive material. A separate temperature control information storage means is provided, however, to store solution and dryer temperatures.

BRIEF DESCRIPTION OF THE DRAWINGS

FIG. 1 is a perspective view of a graphic arts processor utilizing the control system of the present invention.

FIG. 2 shows a machine programming control panel of the processor of FIG. 1.

DETAILED DESCRIPTION OF THE PREFERRED EMBODIMENTS

Figure 3:
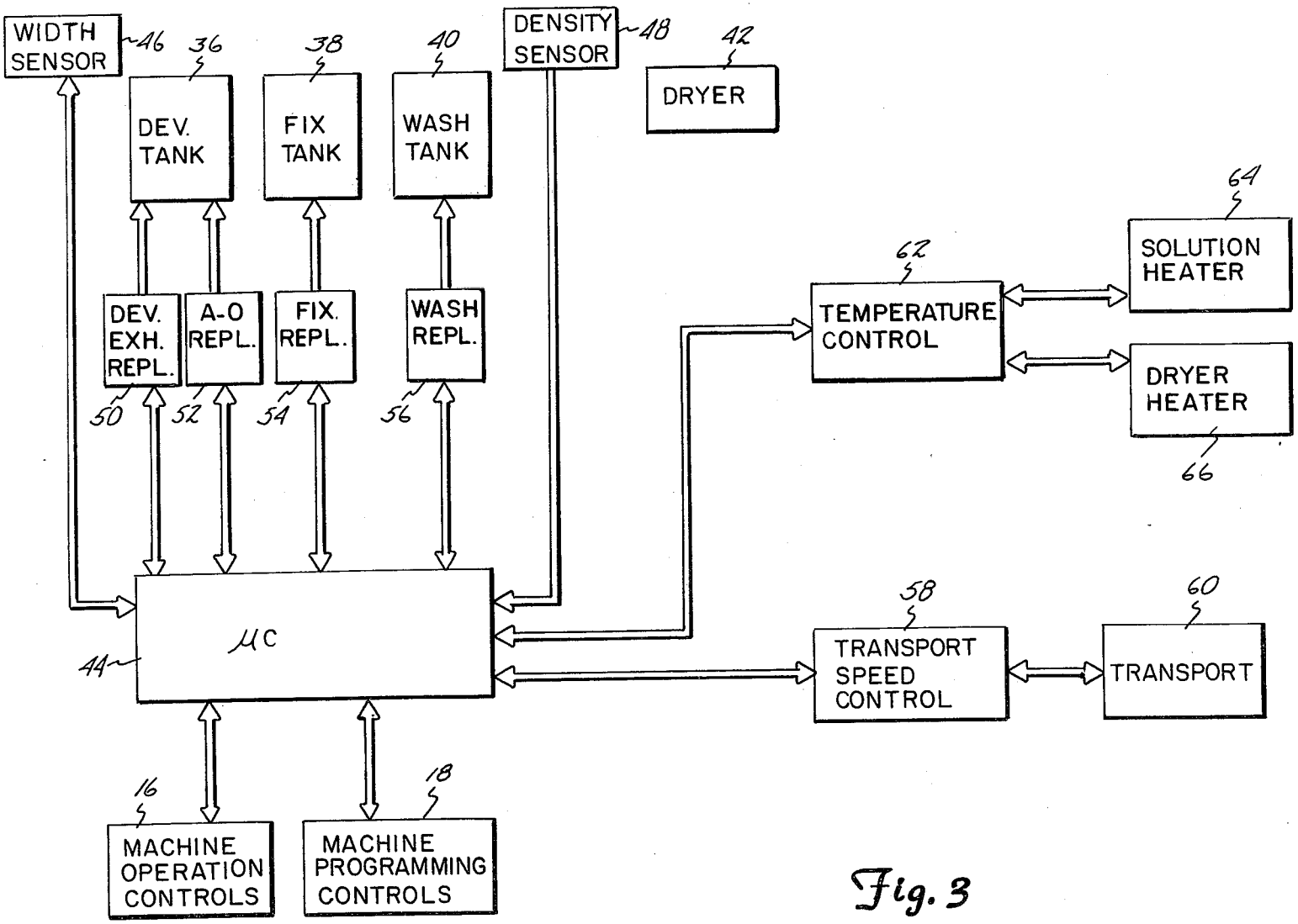
FIG. 3 is a block diagram of the control system of the processor of the present invention.

FIG. 1 shows graphic arts processor 10, which utilizes the present invention. At its front end, processor 10 has a feed table 12 upon which sheets of photosensitive material are fed into the processor through entrance opening 14. Positioned on opposite sides of feed table 12 are left and right control pods 16 and 18, respectively. In a preferred embodiment of the present invention, left control pod 16 contains machine operation controls, such as a MAIN POWER switch, a MAIN POWER light, a SAVER switch, a TIMER switch, a FEED switch, a LIGHTS switch, and REPLENISHMENT switches, which control non-electronic machine functions of processor 10. Right control pod 18 contains machine programming controls by which all machine programming of processor 16 is performed.

The remaining portion of processor 10 is preferably located on the opposite side of a wall (not shown) from the front end of processor 10. The remainder of the processor does not have to be maintained in darkness, and the room in which the remainder of processor 10 is located is preferably a "light room" rather than a "dark room."

Sheets which have been entered through entrance opening 14 are transported through the processor, and are eventually driven out of the rear end of processor 10 through an exit opening (not shown) and into catch tray or basket 22.

Processor 10 also has a built-in rewash entrance slot 24 in its top surface through which previously processed sheets may be fed into processor 10 for rewashing and drying. Located at the left rear end of processor 10 is a rewash control panel (not shown).

FIG. 2 shows the machine programming controls of right control pod 18. The machine programming controls include display 26, which consists of sixteen alphanumerical characters used for information display and to assist the operator during programming. Keyboard 28 consists of thirty-two keys in three groups. Programming group 30 is a group of twenty-four keys arranged in six rows and four columns. Display group 32 is a single row of four keys, as is replenishment group 34.

In the preferred embodiment of the present invention shown in FIG. 2, the first row of keys in programming group 30 consist of "7" "8" "9" and "PASS." The second row consists of "4" "5" "6" and "CLEAR" keys. The third row consists of "1" "2" "3" and "CLEAR ENTRY" keys. The fourth row consists of "-" "0" "." and "ENTER" keys. The fifth row consists of "TIME" "PUMP RATE" "CONTROL STRIPS" and "MANUAL REPLENISH" keys. The sixth row consists of "REPLENISH SELECT" "DEVELOPER REPLENISH" "FIX REPLENISH" and "WASH" keys. All twenty-four keys of programming group 30 are momentary push button switches. The keys of programming group 30 are used for programming of information into memory storage of the processor control system.

Display group 32 is used for displaying actual and set times and temperatures. Display group 30 includes "DEVELOPER TEMP" "DRYER TEMP" "DEVELOPER TIME" and "SET/ACTUAL" keys. SET/ACTUAL key is a push-push switch, while the remaining three keys are momentary push button switches.

Replenishment group 34 is used for selecting replenishment matrices. The switches of replenishment group 34 are labeled "A" "B" "C" and "D." Keys A, B and C are mechanically interlocked switches, so that only one of these three switches can be depressed at any time. The "D" key is a push-push switch.

FIG. 3 illustrates in block diagram the control system of processor 10 in FIG. 1. As shown in FIG. 3, processor 10 includes developer tank 36, fix tank 38, wash tank 40, and dryer 42. The operations of processor 10 are controlled by microcomputer 44. Microcomputer 44 receives signals from machine operation controls of left control pod 16 and machine programming controls of right pod 18. In addition, microcomputer 44 receives signals from width sensor 46, which is positioned proximate entrance opening 14 of processor 10, and from density sensor 48 which is positioned between wash tank 40 and dryer 42. Signals from width sensor 46 provide width and length information from which the area of each sheet of photosensitive material may be determined. Density sensor 48 provides transmission density information from each sheet as it passes out of wash tank 40 and into dryer 42. Based upon stored control information, and signals from left and right control pods 16 and 18 and from sensors 46 and 48, microcomputer 44 controls replenishment of processor fluids through developer exhaustion replenisher 50, anti-oxidation replenisher 52, fix replenisher 54, and wash replenisher 56.

The control system of the present invention also includes transport speed control 58, which controls transport 60 for transporting the sheet through processor 10. In the preferred embodiment, transport speed control 58 includes another microcomputer which is dedicated to the speed control function. Transport speed control 58 communicates with microcomputer 44 and receives control information from microcomputer 44 which is used in controlling transport speed.

Temperature control 62 controls operation of solution heater 64 and dryer heater 66. Temperature control 62 also preferably includes a microcomputer which is dedicated to the temperature control function. Microcomputer 44 communicates with temperature control 62, and provides temperature control information used by temperature control 62 in controlling heaters 64 and 66.

In the processor of the present invention, microcomputer 44 includes digital storage which stores a replenishment control matrix formed from a plurality of individual information matrices for different photosensitive materials. In a preferred embodiment of the present invention, a total of thirty-one information matrices are available. The number of information matrices can, of course, be greater or less than this number, depending upon the anticipated usage of the machine and the number of different types of material it will process.

Each information matrix includes replenishment control information, an indication of whether the photosensitive material is film or paper, and transport speed control information.

The replenishment control information stored in each information matrix depends, of course, upon the particular manner in which replenishment is provided, and the particular information needed to control replenishment. In the following discussion, replenishment control information described is for a preferred embodiment of the present invention which utilizes replenishment controls like those described in my copending patent applications entitled "Automatic Replenisher Control System" Ser. No. 168,019; "Automatic Anti-Oxidation Replenisher Control" Ser. No. 168,020; and "Automatic Inverse Fix Replenisher Control" Ser. No. 168,025. All three of these applications were filed on even date with this application, and are assigned to the same assignee as the present application.

In this preferred embodiment, the replenisher control information stored in each information matrix includes a ten percent aim density value for control strips; a ninety-five percent aim density value for control strips; a developer exhaustion replenishment rate; an indication of whether blender or two-part anti-oxidation chemistry is being used; an anti-oxidation replenishment rate; a fix exhaustion replenishment rate; a carryover rate; a silver density; an indication of the type of wash replenishment (either volume per area, non-saver, or volume per film entry); and a wash replenishment rate.

Table 1 illustrates the programming steps involved in loading the information into a selected information matrix. In the preferred embodiments of the present invention, the information stored in the information matrices can be entered in any order. In addition, the operator can change from matrix to matrix, and can change only selected values in matrix.

In Table 1, the programming steps are preceded by the letter "P," "F" or "D." The letter "P" stands for prompt, and represents a prompting message which microcomputer 44 displays on display 26. The letter "F" represents a format step in which the operator makes one or more key strokes. The letter "D" represents a display step, in which microcomputer 44 echoes back the information just entered and displays that information on display 26.

As seen in Table 1, depressing the control strips key first results in a prompt requesting the operator to indicate which material (i.e. information matrix) is desired. Once the information matrix numbered 1 through 31 is selected, microcomputer 44 prompts the operator through a sequence in which a ten percent aim density value and a ninety-five percent aim density value are entered.

When the DEVELOPER REPLENISH key is depressed, the first prompt once again is a request for the material number (i.e. the information matrix number). Once the matrix is selected, microcomputer 44 prompts the operator, by means of display 26, through a series of steps in which the operator indicates whether the material is paper or film, enters an exhaustion replenishment rate, indicates whether blender or two-part anti-oxidation chemistry is being used, and enters a developer anti-oxidation requirement in milliliters per twenty-four hours.

When the FIX REPLENISH key is depressed, microcomputer 44 first requests the material number, and then prompts the operator through a sequence of steps in which the operator identifies whether the material is paper or film, enters a fix replenishment rate in ml/m$^2$, a carryover rate in ml/m$^2$, and a silver density in gm/m$^2$.

When the WASH REPLENISH key is depressed, microcomputer 44 once again prompts the operator for the material number. Once this has been entered, microcomputer 44 prompts the operator through a sequence of steps in which the material is identified as paper or film, and selects one of three wash replenishment modes: "VOLUME PER AREA," "NONSAVER," or "VOLUME PER FILM ENTRY." If the VOLUME PER AREA mode is selected, the operator also enters a wash replenishment rate in ml/m$^2$. If the operator has selected the VOLUME PER FILM entry mode, a wash replenishment rate in ml/film entry is entered.

The transport speed control information is entered by depressing the DEVELOPER TIME key and the SET-/ACTUAL key. The operator is prompted to enter the matrix number, and then a time-in-developer value in seconds. This value is used during operation of processor 10 to derive a velocity which will yield the desired time-in-developer.

TABLE 1

| | |
|---|---|
| | CONTROL STRIPS key depressed |
| P | MATERIAL 1-31 ? |
| F | 2 digit (1-31) + ENTER |
| D | MATERIAL XX |
| P | 10% AIM DENSITY ? |
| F | 3 digit (0.00-9.99) + ENTER |
| D | X.XX 10% AIM DENSITY |
| P | 95% AIM DENSITY ? |
| F | 3 digit (0.00-9.99) + ENTER |
| D | X.XX 95% AIM DENSITY |
| | DEVELOPER REPLENISH key depressed |
| P | MATERIAL 1-31 ? |
| F | 2 digit (1-31) + ENTER |
| D | MATERIAL XX |
| P | PAPER? Y = 1 NO = 0 |
| F | Single digit (0, 1) + ENTER |
| P | DEXRT ML/M2 |
| F | 4 digit (0-9999) + ENTER |
| D | DEXRT XXXX ML/M2 |
| P | DEVELOPER ANTI-OX |
| P | BLNDR = 1 2PART = 2 |
| F | Single digit (1,2) + ENTER |
| D | DEVAOX BLENDER or DEVAOX TWOPART |
| | If BLNDR then |
| P | MDR ML/24HR |
| F | 5 digit (0-99999) + ENTER |
| D | MDR XXXXX ML/24HR |
| | If 2PART then |
| P | DAOX ML/24HR |
| F | 5 digit (0-99999) + ENTER |
| D | DAOX XXXXX ML/24HR |
| | FIX REPLENISH key depressed |
| P | MATERIAL (1-31)? |
| F | 2 digit (1-31 ) + ENTER |
| D | MATERIAL XX |
| P | FXRTE ML/M2 |
| F | 4 digit (0-9999) – ENTER |
| D | FXRTE XXXX ML/M2 |
| P | CORTE ML/M2 |
| F | 4 digit (0-9999) + ENTER |
| D | CORTE XXXX ML/M2 |
| P | AG DENS G/M2 |
| F | 4 digit (0-99.9) + ENTER |
| D | AG DENS XX.X G/M2 |
| | WASH key depressed |

TABLE 1-continued

| | |
|---|---|
| P | MATERIAL (1-31)? |
| F | 2 digit (1-31) + ENTER |
| D | MATERIAL XX |
| P | VOL/AREA? Y = 1 NO = 0 |
| F | Single digit (0,1) + ENTER |
| | If yes |
| P | WASH ML/M2 |
| F | 4 digit (0-9999) + ENTER |
| D | WASH XXXX ML/M2 |
| | Else |
| P | NONSAVER? Y = 1 NO = 0 |
| F | Single digit (0,1) + ENTER |
| | If no |
| P | VOL/FILM ENTRY? Y = 1 NO = 0 |
| F | Single digit (0,1) + ENTER |
| | If yes |
| P | WASH ML/FILM ENTRY |
| F | 5 digit (0-99999) + ENTER |
| D | WASH XXXXX ML/FILM ENTRY |
| | DEVELOPER TIME key depressed |
| P | MATERIAL (1-31)? |
| F | 2 digit (1-31) + ENTER |
| D | MATERIAL XX |
| P | TIME IN DEVELOPER SEC |
| F | 4 digit (30-150) |
| D | TIME IN DEVELOPER XXXX SEC |

In the programming operations, the CLEAR, CLEAR ENTRY, ENTER and PASS keys have the highest priority. The CLEAR key clears the memory area allocated for storage. The CLEAR ENTRY key clears the information on display 26. The ENTER key causes microcomputer 44 to read the information being displayed, enter the information into storage, and move on to the next prompt. The PASS key clears display 26 and steps on to the next prompt.

In addition to the information stored in each information matrix, other control information is entered through keyboard 28 and stored by microcomputer 44. This includes an operating schedule for the processor including the TURN ON and TURN OFF times for each day of the week. Also stored are pump rates for the developer replenisher 50, anti-oxidation replenisher 52, fix replenisher 54 and wash replenisher 56. These rates are entered through a programming sequence which is initiated by depressing the PUMP RATE key.

Developer temperature and dryer temperature set points are also stored separately from the information matrices. The DEVELOPER TEMP and DRYER TEMP keys, respectively, of display group 32 are used in conjunction with the SET/ACTUAL switch to program the desired temperature set points.

The processor also includes a capability of manual replenishment. Manual replenishment rates are stored by microcomputer 44. The MANUAL REPLENISH key is used to store the desired volumes of manual replenishment. In the embodiment of the present invention illustrated in FIG. 2, replenishment group 34 includes four single switch selectable channels labeled "A," "B," "C" and "D." These channels are user-defined and correspond to four selected information matrices from the larger group of information matrices stored by microcomputer 44. The operator assigns individual information matrices to the A, B, C and D keys by first depressing the REPLENISH SELECT key. Microcomputer 44 then generates a prompt message requesting that the operator enter the number of the material to be assigned to key A. The operator then uses the numerical keys to enter a number between 1 and 31, and depresses the ENTER key. The process is repeated for the B, C and D keys.

In a preferred embodiment of the present invention, the A, B and C keys also function as keys for providing paper density signals. In this embodiment, only the D channel may be used for paper. Microcomputer 44 checks the indication in the information matrix assigned to channels A, B and C, and will not permit an information matrix usable with paper to be stored in channels A, B or C.

During normal operation, the operator selects the information stored in channels A, B, C or D to control replenishment and transport speed of the processor. This selection is done by depressing keys A, B, C or D.

If the operator depresses the D key, and the information matrix stored in channel D is for paper, microcomputer 44 automatically lights the A, B and C keys, which reveals "25%" "50%" and "75%" legends. The operator then depresses one of the three keys to provide paper density signals corresponding to 25% density, 50% density or 75% density. The paper density signals are provided because density sensor 48 is unable to distinguish densities of paper. When the D channel is selected, microcomputer 44 automatically uses the paper density signals supplied from replenishment group 34 rather than the film density signals from density sensor 48.

In the processor of the present invention, the operator may change from one channel to another at any time. As soon as material has left developer tank 36, the transport speed may be changed, and the machine is ready to feed material. With the present invention, the temperature set points are maintained separately from the information matrices. This avoids long delay times when a change from one channel to another is made. The time required to vary solution or dryer temperatures to a new set point can be quite long. By having temperature set points separate of the information matrices, the operator may make a decision whether he wishes to wait for temperature changes to be made, or whether he wishes to operate the processor with the present set temperatures.

In conclusion, the control system of the present invention provides control of a processor usable with both photosensitive film and paper. By storing, in each information matrix, an indication of whether the material is film or paper, the control system automatically takes the appropriate actions to ensure that accurate replenishment will occur.

Although the present invention has been described with reference to preferred embodiments, workers skilled in the art will recognize that changes may be made in form and detail without departing from the spirit and scope of the invention.

What is claimed is:

1. In a processor of photosensitive material, an improvement comprising:

storage means for storing a plurality of information matrices for a plurality of different photosensitive materials, each information matrix including replenishment control information, and an indication of whether the photosensitive material is film or paper;

select means for selecting one of the information matrices; and replenishment control means for providing replenishment of processor fluid as a function of the replenishment control information from the selected information matrix and the indication of whether the photosensitive material is film or paper.

2. The invention of claim 1 and further comprising:

density sensing means for providing film density signals indicative of measured density of photosensitive film; and means for providing paper density signals indicative of density of photosensitive paper.

3. The invention of claim 2 wherein the replenishment control means provides replenishment of processor fluid as a function of the film density signals if the selected information matrix contains an indication that the photosensitive material is film, and provides replenishment of processor fluid as a function of the paper density signals if the selected information matrix contains an indication that the photosensitive material is paper.

4. The invention of claim 1 and further comprising:

transport speed control means for controlling transport speed of photosensitive material through the processor.

5. The invention of claim 4 wherein each information matrix further includes transport speed control information, and wherein the transport speed control means controls transport speed as a function of the transport speed control information from the selected information matrix.

6. The invention of claim 1 or 5 and further comprising:

solution heater means for heating processor fluid;

dryer heater means for providing heat to dry photosensitive material; and temperature control means for controlling the solution heater means and the dryer heater means.

7. The invention of claim 6 and further comprising:

temperature control storage means for storing temperature control information independent of the information matrices; and wherein the temperature control means controls the solution heater means and the dryer heater means as a function of the temperature control information.

8. The invention of claim 1 wherein the select means comprises:

a plurality of channel selection switches; and means for assigning one of the plurality of information matrices stored in the storage means to each of the channel selection switches.

9. The invention of claim 8 wherein the plurality of selection switches includes certain selection switches which are designated for film and at least one selection switch which is designated for paper, and wherein the means for assigning checks the indication of whether the photosensitive material is film or paper when assigning information matrices to the selection switches.

10. The invention of claim 1 wherein the replenishment control information stored in each information matrix includes a developer exhaustion replenishment rate, an anti-oxidation replenishment rate, and a fix replenishment rate.

11. The invention of claim 10 wherein the replenishment control information further includes an indication of type of wash replenishment and a wash replenishment rate.

12. The invention of claim 10 wherein the replenishment control information includes a carryover replenishment rate.

13. The invention of claim 10 wherein the replenishment control information includes silver density in mass/area.

14. The invention of claim 10 wherein the replenishment control information includes an indication of whether blender anti-oxidation chemistry or two-part anti-oxidation chemistry is used.

15. The invention of claim 10 wherein the replenishment control information includes aim density for control strips.

* * * * *